US011471924B2

(12) United States Patent
Kappes et al.

(10) Patent No.: US 11,471,924 B2
(45) Date of Patent: Oct. 18, 2022

(54) TOOLS, MACHINES, AND METHODS FOR PROCESSING PLANAR WORKPIECES

(71) Applicant: TRUMPF Werkzeugmaschinen GmbH + Co. KG, Ditzingen (DE)

(72) Inventors: Jens Kappes, Leinfelden-Echterdingen (DE); Markus Wilhelm, Gerlingen (DE); Rainer Hank, Hochdorf (DE); Marc Klinkhammer, Ditzingen (DE); Leonard Schindewolf, Rutesheim (DE); Simon Ockenfuss, Boeblingen (DE); Dennis Traenklein, Nufringen (DE); Alexander Tatarczyk, Hoeffingen (DE); Joerg Neupert, Stuttgart (DE); Dominik Bitto, Muenchingen (DE); Markus Maatz, Leinfelden-Echterdingen (DE); Christian Jakisch, Boeblingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 203 days.

(21) Appl. No.: 16/363,486

(22) Filed: Mar. 25, 2019

(65) Prior Publication Data

US 2019/0217360 A1 Jul. 18, 2019

Related U.S. Application Data

(63) Continuation of application No. PCT/EP2017/074306, filed on Sep. 26, 2017.

(30) Foreign Application Priority Data

Sep. 26, 2016 (DE) ..... 102016118175.7
Oct. 20, 2016 (DE) ..... 102016120035.2

(51) Int. Cl.
*B21D 17/04* (2006.01)
*B21D 19/04* (2006.01)
(Continued)

(52) U.S. Cl.
CPC ..... *B21D 17/04* (2013.01); *B21D 19/043* (2013.01); *B21D 28/12* (2013.01); *B21D 35/001* (2013.01)

(58) Field of Classification Search
CPC ..... B21D 17/00; B21D 17/04; B21D 19/04; B21D 19/043; B21D 28/12; B21D 28/125; B21D 35/001; B30B 3/02
(Continued)

(56) References Cited

U.S. PATENT DOCUMENTS 4,242,898 A 1/1981 Salvagnini
4,412,469 A 11/1983 Hirata et al.
(Continued)

FOREIGN PATENT DOCUMENTS

CN 202984412 U 6/2013
DE 9307907 U1 7/1993
(Continued)

OTHER PUBLICATIONS

U.S. Office Action in U.S. Appl. No. 16/363,516, dated May 28, 2021, 19 pages.
(Continued)

*Primary Examiner* — Adam J Eiseman
*Assistant Examiner* — Fred C Hammers
(74) *Attorney, Agent, or Firm* — Fish & Richardson P.C.

(57) ABSTRACT

A tool includes an upper tool having a clamping shaft and an upper main body that lie on a common positioning axis, a processing tool opposite the clamping shaft that has at least one processing edge that extends at least partially along a holding-down surface of the main upper body, a lower tool
(Continued)

having a lower main body with a rest surface for the workpiece and a lower positioning axis oriented perpendicular to the rest surface, a counter tool body on the lower main body, the counter tool body having a counter roller with at least one counter edge opposite the at least one processing edge of the processing tool, and a processing device adjacent to the at least one counter edge that has at least one curved counter surface oriented in the longitudinal direction of the processing edge of the processing tool.

10 Claims, 6 Drawing Sheets

(51) Int. Cl.
*B21D 28/12* (2006.01)
*B21D 35/00* (2006.01)

(58) Field of Classification Search
USPC ..... 72/75, 214, 220; 100/210
See application file for complete search history.

(56) References Cited

U.S. PATENT DOCUMENTS

| | | | | |
|---|---|---|---|---|
| 4,520,646 | A | 6/1985 | Pauzin | |
| 4,951,375 | A * | 8/1990 | Erlenmaier | B21D 37/145 483/14 |
| 5,259,100 | A | 11/1993 | Takahashi | |
| 5,367,770 | A | 11/1994 | McCaughey | |
| 5,787,775 | A | 8/1998 | Stevens et al. | |
| 5,842,369 | A | 12/1998 | Kutschker | |
| 6,058,756 | A | 5/2000 | Kutschker | |
| 6,109,090 | A * | 8/2000 | Perazzolo | B21D 28/04 72/442 |
| 6,112,568 | A | 9/2000 | Lindstrom | |
| 6,190,090 | B1 * | 2/2001 | Campbell | B08B 9/0551 15/104.061 |
| 6,655,250 | B1 | 12/2003 | Ishii et al. | |
| 6,715,329 | B1 | 4/2004 | Hametner | |
| 7,659,490 | B2 | 2/2010 | Beilke | |
| 8,001,823 | B2 | 8/2011 | Straka et al. | |
| 8,042,369 | B2 | 10/2011 | Bytow et al. | |
| 8,087,278 | B2 | 1/2012 | Deis et al. | |
| 8,201,435 | B2 | 6/2012 | Erleamaier | |
| 8,375,763 | B2 | 2/2013 | Bauer | |
| 8,511,128 | B2 | 8/2013 | Boepple | |
| 8,627,753 | B2 * | 1/2014 | Laib | B21D 28/36 83/553 |
| 2002/0072456 | A1 | 6/2002 | Ichikawa | |
| 2006/0162413 | A1 | 7/2006 | Bauer et al. | |
| 2007/0105488 | A1 | 5/2007 | Bylow et al. | |
| 2009/0211326 | A1 * | 8/2009 | Laib | B21D 28/24 72/332 |
| 2010/0101297 | A1 | 4/2010 | Bauer et al. | |
| 2012/0006211 | A1 * | 1/2012 | Bytow | B21D 19/005 100/210 |
| 2014/0090443 | A1 | 4/2014 | Schmauder et al. | |
| 2014/0283576 | A1 | 9/2014 | Jin et al. | |
| 2016/0107847 | A1 | 4/2016 | Grunewald | |
| 2019/0217362 | A1 | 7/2019 | Klinkhammer et al. | |
| 2019/0217367 | A1 | 7/2019 | Klinkhammer et al. | |

FOREIGN PATENT DOCUMENTS

| | | | |
|---|---|---|---|
| DE | 20018936 | U1 | 1/2001 |
| DE | 696 16 689 | | 8/2002 |
| DE | 10223637 | A1 | 12/2003 |
| DE | 10 2005 003 558 | | 7/2006 |
| DE | 10 2006 049 044 | | 4/2008 |
| DE | 102009013437 | A1 | 10/2009 |
| DE | 102013000864 | | 3/2014 |
| EP | 0757926 | | 2/1997 |
| EP | 1688195 | | 8/2006 |
| EP | 2 527 058 | | 7/2014 |
| EP | 3 106 241 | | 12/2016 |
| JP | S54 137469 | | 10/1979 |
| JP | 2005131655 | A | 5/2005 |
| JP | 2007-534498 | | 11/2007 |
| WO | WO 2014206817 | | 12/2014 |

OTHER PUBLICATIONS

International Preliminary Report on Patentability in International Application No. PCT/EP2017/074306, dated Mar. 26, 2019, 11 pages (English translation).
International Search Report and Written Opinion in International Application No. PCT/EP2017/074306, dated Jan. 31, 2018, 18 pages (with English translation).
PCT International Search Report and Written Opinion in International Application No. PCT/EP2017/074298, dated Jan. 9, 2018, 16 pages (with English translation).
PCT International Search Report and Written Opinion in International Application No. PCT/EP2017/074286, dated Jan. 9, 2018, 13 pages (with English translation).
U.S. Office Action in U.S. Appl. No. 16/363,516, dated Nov. 27, 2020, 18 pages.
U.S. Office Action in U.S. Appl. No. 16/364,398, dated Oct. 13, 2020, 16 pages.

* cited by examiner

TOOLS, MACHINES, AND METHODS FOR PROCESSING PLANAR WORKPIECES

CROSS REFERENCE TO RELATED APPLICATIONS

This application is a continuation of and claims priority under 35 U.S.C. § 120 from PCT Application No. PCT/EP2017/074306 filed on Sep. 26, 2017, which claims priority from German Application No. 10 2016 118 175.7, filed on Sep. 26, 2016, and German Application No. 10 2016 120 035.2 filed on Oct. 20, 2016. The entire contents of each of these priority applications are incorporated herein by reference.

TECHNICAL FIELD

The disclosure relates to tools and methods for processing planar workpieces, such as metal sheets.

BACKGROUND

A machine tool for machining workpieces is known from EP 2 527 058 B1. That document discloses a machine tool in the form of a press for processing workpieces, wherein an upper tool is provided on a stroke device that is moveable relative to a workpiece to be processed, along a stroke axis in the direction of the workpiece and in the opposite direction. A lower tool is provided in the stroke axis and opposite the upper tool and is positioned towards a lower side. A stroke drive device for a stroke movement of the upper tool is controlled by a wedge gear. The stroke drive device with the upper tool arranged thereon is moveable along a positioning axis. The lower tool is moved synchronously relative the upper tool.

Document DE 10 2006 049 044 A1 discloses a tool for shaping workpieces that includes an upper tool, on which a roller is provided, and is rotatable about a rotation axis perpendicular to the positioning axis of the upper tool. This roller has a conical shaping surface as processing device. A counter roller is provided on the lower tool within the rest surface on the main body of the lower tool. This counter roller is rotatable about a rotation axis perpendicular to the positioning axis of the lower tool. The rotation axis of the roller on the upper tool is thus oriented parallel to that of the lower tool. To process a workpiece, the upper tool and lower tool are moved towards one another in a stroke direction until the workpiece to be processed is clamped between the roller of the upper tool and the counter roller of the lower tool. In the clamped state the shaping surface of the roller and the counter surface of the counter roller, which is opposite in the stroke direction, cooperate. A shaping such as a shoulder is created on the workpiece by moving the workpiece in a horizontal plane between the upper tool and lower tool in a continuous sequence. The upper tool and lower tool are arranged here in a stationary manner in the machine tool.

Document DE 10 2005 003 558 A1 discloses a tool for shaping workpieces that includes an upper tool on which a roller with a groove-shaped indentation is provided. This roller is rotatable about a rotation axis perpendicular to the positioning axis of the upper tool. A counter roller is provided on the lower tool within the rest surface on the main body of the lower tool. This counter roller is received rotatably about a rotation axis perpendicular to the positioning axis of the lower tool. To process a workpiece, the upper tool and lower tool are moved towards one another in the stroke direction until the workpiece to be processed is clamped between the roller of the upper tool and the counter roller of the lower tool. The shaping is formed by moving the workpiece in a horizontal plane between the upper tool and lower tool. A similar tool is disclosed in EP 0 757 926 B1. A tool having an aforementioned design is also known from U.S. Pat. No. 8,042,369 B2.

Document U.S. Pat. No. 5,787,775 A discloses a cutting tool in a punch press, in which the cutting tool is freely rotatable about a stroke axis oriented perpendicular to the workpiece plane of the workpiece to be processed. The rotating cutting blade acts on the upper tool with a counter cutting tool arranged in a stationary manner on the lower tool. The upper tool can be rotated synchronously with the lower tool to produce a cutting movement, wherein the two stroke axes are oriented congruently relative to one another.

SUMMARY

The disclosure provides tools, machines, and methods for processing planar workpieces, by which the versatility of the processing of workpieces is increased.

A tool for processing planar workpieces, such as metal sheets, has an upper tool, that includes a clamping shaft and a main body, which lie in a common positioning axis, and a processing tool, that is arranged opposite the clamping shaft and on the main body and has at least one processing edge, and a lower tool, which includes a main body with a rest surface for the workpiece and has at least one counter edge, which is provided on the main body, and a positioning axis, which lies in the main body and is oriented perpendicularly to the rest surface. The upper tool and lower tool are moveable towards one another in a stroke movement to process a workpiece arranged between them. A processing plane is formed between the upper tool and the lower tool. The at least one processing edge of the processing tool extends on the upper tool at least partially along a holding-down surface. The at least one counter edge of the counter tool is opposite the at least one processing edge of the processing tool. A processing device of the counter tool body is provided adjacently to the at least one counter edge and has at least one curved counter surface oriented in the longitudinal direction of the processing edge of the processing tool.

By this tool a processing tool is created, with which the workpiece can be processed by a pendulum stroke. In the case of a pendulum stroke the upper and/or lower tool are/is moved successively along the processing plane and are displaced relative to one another in alternation. During the traversing movement the processing edge of the processing tool and the counter edge of the counter tool body act on the workpiece to hold it clamped. The workpiece is processed, for example cut, punched, embossed, and/or shaped, by the curved counter surface of the processing device on the counter tool body that protrudes relative to the processing edge on the processing tool. Friction between the lower tool and the workpiece to be processed during the pendulum stroke can be reduced by the counter tool body formed as a counter roller.

The at least one processing edge of the processing tool can extend on the upper tool along the entire main body of the upper tool. A maximum length of a working stroke or pendulum stroke is thus made possible to introduce a processing contour into the workpiece.

It is advantageously provided that the processing edge is oriented perpendicularly to the positioning axis. Simple force ratios can thus be provided, and in addition increased shaping forces are attained. The processing tool can cross the positioning axis, and therefore even better conditions can be attained for the processing process.

In some embodiments, a processing surface is provided adjacently to the processing edge, and is formed typically in an indentation in the main body. For example, a processing contour can thus be delimited in respect of the depth relative to the workpiece plane.

The indentation in the main body is advantageously delimited by two processing edges of the processing tool distanced from one another. For example a width of the contour that is formed in the workpiece is thus delimited.

On the lower tool, the counter tool body formed as a counter roller is oriented about a rotation axis, e.g., perpendicular to the positioning axis of the lower tool. Simple geometric conditions can thus be created, and make it possible to introduce a high shaping force into the workpiece.

The counter edge on the counter roller can be peripheral. A support surface can be provided on the counter roller, adjacently to the counter edge, and is oriented relative to the holding-down surface on the main body of the upper tool. It is thus made possible that, during the relative movement of the upper tool and/or lower tool to process the workpiece, a clamping position of the workpiece can be maintained, wherein a minimization of friction is made possible, such as in the event of a traversing movement of the lower tool relative to the upper tool.

A processing surface of the processing device is advantageously adjacent to the counter edge of the counter roller. This processing surface is opposite the support surface of the counter roller. This processing surface can be formed in respect of its shape depending on the punching, cutting, embossing, and/or shaping process to be carried out.

The counter roller formed as a counter tool body can have two counter edges distanced from one another, the spacing therebetween lying in the plane of the support of the lower tool, opposite the processing edges of the processing tool distanced from one another in parallel, with a counter surface of the processing device extending between the counter edges of the counter roller and being raised in the direction of the upper tool. It is thus made possible that a defined contour is formed in the workpiece when the upper tool and the lower tool are moved towards one another to transfer into a processing position, in which the workpiece is held clamped between the upper tool and lower tool. The processing device of the counter roller engages in the indentation in the main body.

The counter surface of the processing device can be provided on the counter roller as a shaping surface. For example, a bead can thus be formed. The contour of the bead is dependent on the cross-sectional geometry of the processing device and/or the course of the indentation, which borders at least one processing edge or runs between the two parallel, mutually distanced processing edges. Furthermore, the counter surface on the counter roller can have at least one cutting edge. In this case the processing edge on the upper tool and the counter edge on the counter roller can hold the workpiece in a defined position, wherein the cutting edge dips into the indentation in the upper tool and makes a cut in the workpiece. Furthermore, it can be provided alternatively that the counter surface of the processing device has a shaping surface and a cutting edge. For example, flanges can thus be formed in the workpiece. A further alternative embodiment of the counter surface of the processing device provides that this has two cutting edges oriented relative to the processing edges on the upper tool. A material strip can thus be cut out from the workpiece.

In some embodiments, the processing tool on the upper tool provides that the processing surface of the processing tool is formed as a support roller in the indentation. An additional minimization of friction during the processing process to form a contour in the workpiece can thus be attained.

Also described are machines for processing planar workpieces, in which a tool according to one of the previously described embodiments is used and the traversing movement of the upper tool along the upper positioning axis and the traversing movement of the lower tool along the lower positioning axis each can be controlled independently of each other. A pendulum stroke for forming a processing contour in the workpiece can thus be controlled and performed. In the case of a pendulum stroke the upper tool and the lower tool perform a successive traversing movement along the processing plane between the upper and lower tool, wherein the length of the particular traversing movement is limited, such that the workpiece is held between the upper tool and the lower tool. The processing contour can be a contour formed by a punching, cutting, embossing, and/or shaping process.

In another aspect, the disclosure provides methods for processing planar workpieces, such as metal sheets, in which a tool according to one of the above-described embodiments is used and, to process the workpiece, the upper tool and the lower tool are controlled with a stroke movement, such that the workpiece is held clamped between the upper tool and the lower tool and, to process the workpiece, the upper tool and the lower tool are rotated individually or jointly relative to one another about the positioning axis of the upper and lower tool, or the upper tool and the lower tool are displaced individually or jointly relative to one another along the positioning axis, or the upper tool and the lower tool are rotated individually or jointly relative to one another about the positioning axis and are displaced individually or jointly relative to one another along the positioning axis. This processing of the workpiece has the advantage that the workpiece can be held stationary during the processing. The processing of the workpiece, such as a punching, cutting, embossing, and/or shaping process, is performed by a traversing movement of the upper tool and/or the lower tool and/or a rotary movement of the upper and/or lower tool relative to one another.

In some embodiments, a method for processing planar workpieces provides that, to process the workpiece after a stroke movement of the upper tool and/or the lower tool, so as to hold the workpiece clamped therebetween, a first traversing movement of the lower tool relative to the upper tool along the lower positioning axis is controlled, such that the counter tool body is displaced relative to the processing tool along the lower positioning axis, and then a traversing movement of the upper tool along the upper positioning axis is controlled, while the lower tool is held stationary. It is thus made possible that, in the case of the first-mentioned traversing movement of the lower tool, the workpiece is processed, wherein the workpiece is positioned in a stationary manner, or is fixed, relative to the upper tool. There is no relative movement between the workpiece and the upper tool. The contour is thus formed in the workpiece on account of the traversing movement of the lower tool. With a subsequent traversing movement of the upper tool, the lower tool is held stationary, wherein the upper tool is displaced so as to be positioned back in a starting position relative to the lower tool, so as to perform a subsequent working stroke or pendulum stroke. In this starting position the positioning axes of the upper and lower tool can be aligned, for example.

The traversing movement of the upper tool and the lower tool relative to one another along the upper and lower positioning axis is controlled with a maximum working stroke, wherein the workpiece is held clamped by the processing edge of the processing tool on the upper tool and the counter surface of the processing device on the lower body.

In some embodiments, the method provides that, during the processing of the workpiece, such as during the traversing movement of the lower tool relative to the stationary upper tool, a distance of the holding-down surface of the upper tool relative to the rest surface of the lower tool is held constant. Uniform conditions during the processing of the workpiece can thus be created.

Other features and advantages of the invention will be apparent from the following detailed description, the drawings, and from the claims.

DESCRIPTION OF DRAWINGS

The invention and further advantageous embodiments and developments thereof will be described and explained in greater detail hereinafter with reference to the examples shown in the drawings. The features inferred from the description and the drawings can be applied in accordance with the invention individually or in any combination. Figure

DETAILED DESCRIPTION

Figure 1:
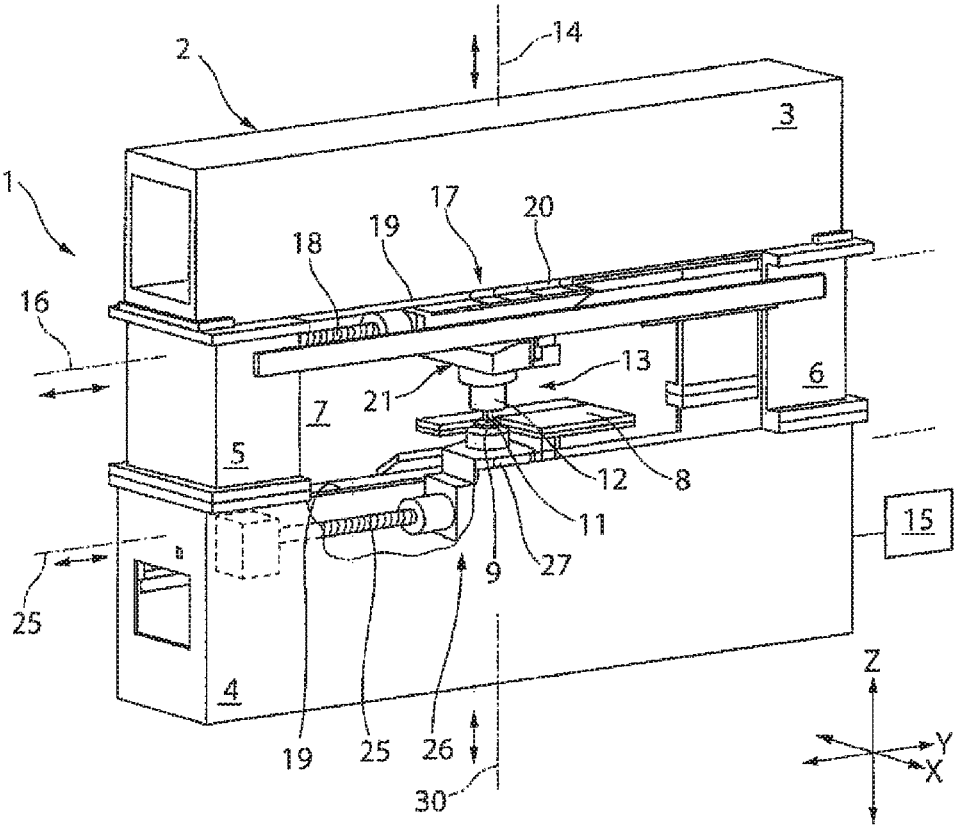
FIG. 1 shows a perspective view of a processing machine.

FIG. 1 shows a processing machine 1 that is configured as a punch press. The processing machine 1 includes a supporting structure with a closed machine frame 2 that includes two horizontal frame limbs 3, 4 and two vertical frame limbs 5 and 6. The machine frame 2 surrounds a frame interior 7 that forms the working area of the processing machine 1 with an upper tool 11 and a lower tool 9.

The processing machine 1 is used to process planar workpieces 10, which for the sake of simplicity have not been shown in FIG. 1, and can be arranged in the frame interior 7 for processing purposes. A workpiece 10 to be processed is placed on a workpiece support 8 provided in the frame interior 7. The lower tool 9, for example in the form of a die, is mounted in a recess in the workpiece support 8 on the lower horizontal frame limb 4 of the machine frame 2. This die can have a die opening. In the case of a punching operation the upper tool 11 is a punch that dips into the die opening of the lower tool 9 formed as a die.

The upper tool 11 and lower tool 9, instead of being a punch and a die for punching, can also be a bending punch and a bending die for shaping workpieces 10. The upper tool 11 is fixed in a tool receptacle on a lower end of a ram 12. The ram 12 is part of a stroke drive device 13, by which the upper tool 11 can be moved in a stroke direction along a stroke axis 14. The stroke axis 14 runs in the direction of the Z axis of the coordinate system of a numerical controller 15 of the processing machine 1 indicated in FIG. 1. The stroke drive device 13 can be moved perpendicular to the stroke axis 14 along a positioning axis 16 in the direction of the double-headed arrow. The positioning axis 16 runs in the direction of the Y direction of the coordinate system of the numerical controller 15. The stroke drive device 13 receiving the upper tool 11 is moved along the positioning axis 16 by a motor drive 17.

The movement of the ram 12 along the stroke axis 14 and the positioning of the stroke drive device 13 along the positioning axis 16 are achieved by the motor drive 17, that can be configured in the form of a drive assembly 17, e.g., a spindle drive assembly, with a drive spindle 18 running in the direction of the positioning axis 16 and fixedly connected to the machine frame 2. The stroke drive device 13, in the event of movements along the positioning axis 16, is guided on two guide rails 19 of the upper frame limb 3, of which one guide rail 19 can be seen in FIG. 1. The other guide rail 19 runs parallel to the visible guide rail 19 and is distanced therefrom in the direction of the X axis of the coordinate system of the numerical controller 15. Guide shoes 20 of the stroke drive device 13 run on the guide rails 19. The mutual engagement of the guide rail 19 and the guide shoe 20 is such that this connection can also bear a load acting in the vertical direction. The stroke device 13 is mounted on the machine frame 2 via the guide shoes 20 and the guide rails 19. A further component of the stroke drive device 13 is a wedge gear 21, by which the position of the upper tool 11 relative to the lower tool 9 is adjustable.

The lower tool 9 is received moveably along a lower positioning axis 25. This lower positioning axis 25 runs in the direction of the Y axis of the coordinate system of the numerical controller 15. The lower positioning axis 25 can be oriented parallel to the upper positioning axis 16. The lower tool 9 can be moved directly on the lower positioning axis 16 by a motor drive assembly 26 along the positioning axis 25. Alternatively or additionally, the lower tool 9 can also be provided on a stroke drive device 27 that is moveable along the lower positioning axis 25 by the motor drive assembly 26. This drive assembly 26 can be configured as a spindle drive assembly. The structure of the lower stroke drive device 27 can correspond to that of the upper stroke drive device 13. The motor drive assembly 26 likewise can correspond to the motor drive assembly 17.

The lower stroke drive device 27 is likewise mounted displaceably on guide rails 19 associated with a lower horizontal frame limb 4. Guide shoes 20 of the stroke drive device 27 run on the guide rails 19, such that the connection between the guide rails 19 and guide shoes 20 at the lower tool 9 can also bear a load acting in the vertical direction. Accordingly, the stroke drive device 27 is also mounted on the machine frame 2 via the guide shoe 20 and the guide rails 19, moreover at a distance from the guide rails 19 and guide shoes 20 of the upper stroke drive device 13. The stroke drive device 27 can also include a wedge gear 21, by which the position or height of the lower tool 9 along the Z axis is adjustable.

Via the numerical controller 15, both the motor drives 17 for a traversing movement of the upper tool 11 along the upper positioning axis 16 and the one or more motor drives 26 for a traversing movement of the lower tool 9 along the lower positioning axis 25 can be controlled independently of each other. The upper and lower tool 11, 9 are thus moveable synchronously in the direction of the Y axis of the coordinate system. An independent traversing movement of the upper and lower tool 11, 9 in different directions can also be controlled. This independent traversing movement of the upper and lower tool 11, 9 can be controlled simultaneously. As a result of the decoupling of the traversing movement between the upper tool 11 and the lower tool 9, an increased versatility of the processing of workpieces 10 can be attained. The upper and lower tool can be configured to process the workpieces 10 in many ways.

Figure 2:
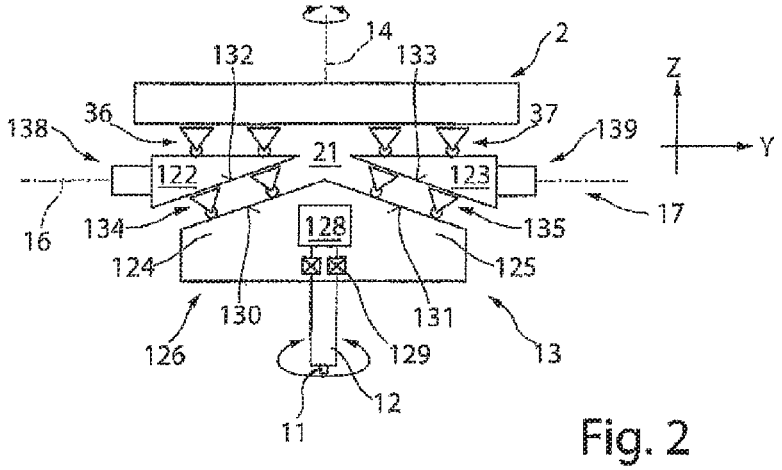
FIG. 2 shows a schematic depiction of the fundamental structure of a stroke drive device and a motor drive of FIG. 1.

One component of the stroke drive device 13 is the wedge gear 21 and is shown in FIG. 2. The wedge gear 21 includes two drive-side wedge gear elements 122, 123, and two output-side wedge gear elements 124, 125. The latter are combined structurally to form a unit in the form of an output-side double wedge 126. The ram 12 is mounted on the output-side double wedge 126 so as to be rotatable about the stroke axis 14. A motor rotary drive device 128 is accommodated in the output-side double wedge 126 and advances the ram 12 about the stroke axis 14 as necessary. Here, both a left-handed and a right-handed rotation of the ram 12 in accordance with the double-headed arrow in FIG. 2 is possible. A ram mounting 129 is shown schematically. The ram mounting 129 allows low-friction rotary movements of the ram 12 about the stroke axis 14, supports the ram 12 in the axial direction, and dissipates loads that act on the ram 12 in the direction of the stroke axis 14 in the output-side double wedge 126.

The output-side double wedge 126 is defined by a wedge surface 130, and by a wedge surface 131 of the output-side gear element 125. Wedge surfaces 132, 133 of the drive-side wedge gear elements 122, 123 are arranged opposite the wedge surfaces 130, 131 of the output-side wedge gear elements 124, 125. By longitudinal guides 134, 135, the drive-side wedge gear element 122 and the output-side wedge gear element 124, and also the drive-side wedge gear element 123 and the output-side wedge gear element 125, are guided moveably relative to each other in the direction of the Y axis, that is to say in the direction of the positioning axis 16 of the stroke drive device 13.

The drive-side wedge gear element 122 has a motor drive unit 138, and the drive-side wedge gear element 123 has a motor drive unit 139. Both drive units 138, 139 together form the spindle drive assembly 17.

The drive spindle 18 shown in FIG. 1 is common to the motor drive units 138, 139 and is configured in the form of a drive device that is mounted on the machine frame 2 and consequently on the supporting structure.

The drive-side wedge gear elements 122, 123 are operated by the motor drive units 138, 139 in such a way that the wedge gear elements move, for example, towards each other along the positioning axis 16, whereby a relative movement is performed between the drive-side wedge gear elements 122, 123 on the one hand and the output-side wedge gear elements 124, 125 on the other hand. As a result of this relative movement, the output-side double wedge 126 and the ram 12 mounted thereon is moved downwardly along the stroke axis 14. The punch 11 mounted for example on the ram 12 performs a working stroke and in so doing processes a workpiece 10 mounted on the workpiece rest 28, 29 or the workpiece support 8. By an opposite movement of the drive wedge elements 122, 123, the ram 12 is in turn raised or moved upwardly along the stroke axis 14.

The above-described stroke drive device 13 of FIG. 2 can be of the same design as the lower stroke drive device 27 that receives the lower tool 9.

Figure 3:
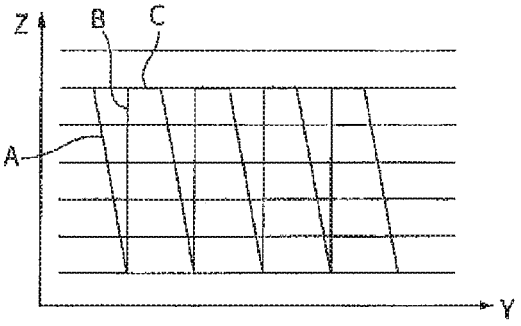
FIG. 3 shows a schematic graph of a superposed stroke movement in the Y and Z direction of the ram of FIG. 1.

FIG. 3 shows a schematic graph of a possible stroke movement of the ram 12. The graph shows a stroke profile along the Y axis and the Z axis. By a superposed control of a traversing movement of the ram 12 along the stroke axis 14 and along the positioning axis 16, an obliquely running stroke movement of the stroke ram 12 downwardly towards the workpiece 10 can, for example, be controlled, as shown by the first straight line A. Once the stroke has been performed, the ram 12 can then be lifted vertically, for example, as illustrated by the straight line B. An exclusive traversing movement along the Y axis is then performed in accordance with the straight line C, to position the ram 12 for a new working position relative to the workpiece 10. The previously described working sequence can then be repeated. If the workpiece 10 is moved on the workpiece rest surface 28, 29 for a subsequent processing step, a traversing movement along the straight line C can be avoided.

The possible stroke movement of the ram 12 on the upper tool 11 shown in the graph in FIG. 3 can be combined with a lower tool 9 that is held stationary. Here, the lower tool 9 is positioned within the machine frame 2 in such a way that, at the end of a working stroke of the upper tool 11, the upper and lower tools 11, 9 each assume a defined position.

This exemplary superposed stroke profile can be controlled both for the upper tool 11 and the lower tool 9. Depending on the processing of the workpiece 10 that is to be performed, a superposed stroke movement of the upper tool and/or lower tool 9 can be controlled.

Figure 4:
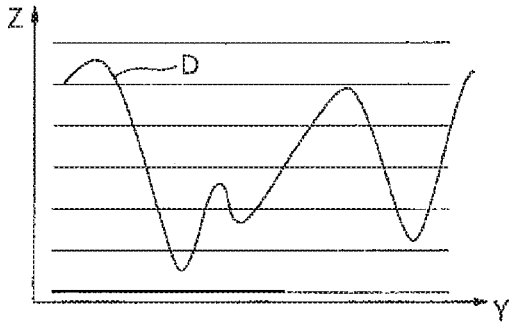
FIG. 4 shows a schematic graph of a further superposed stroke movement in the Y and Z direction of the ram of FIG. 1.

FIG. 4 shows a schematic graph illustrating a stroke movement of the ram 12 in accordance with the line D, shown by way of example, along a Y axis and a Z axis. In contrast to FIG. 3, in this exemplary embodiment a stroke movement of the ram 12 can pass through a curve profile or arc profile by controlling a superposition of the traversing movements in the Y direction and Z direction appropriately by the controller 15. By a versatile superposition of this kind of the traversing movements in the X direction and Z direction, specific processing tasks can be performed. The control of a curve profile of this kind can be provided for the upper tool 11 and/or lower tool 9.

Figure 5:
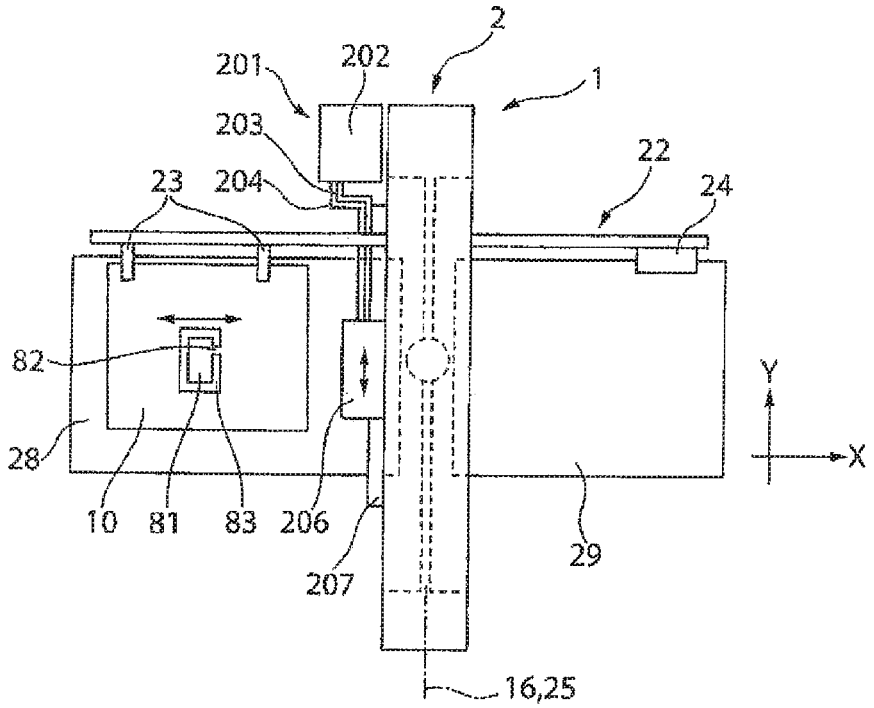
FIG. 5 shows a schematic view from above of the processing machine of FIG. 1 with workpiece rest surfaces.

FIG. 5 shows a schematic view of the processing machine 1 of FIG. 1. Workpiece rests 28, 29 extend laterally in one direction each on the machine frame 2 of the processing machine 1. The workpiece rest 28 can, for example, be associated with a loading station (not shown in greater detail), by which unprocessed workpieces 10 are placed on the workpiece rest surface 28. A feed device 22 is provided adjacent to the workpiece rest surface 28, 29 and includes a plurality of grippers 23 to grip the workpiece 10 placed on the workpiece rest 28. The workpiece 10 is guided through the machine frame 2 in the X direction by the feed device 22. The feed device 22 can also be controlled so as to be moveable in the Y direction. A free traversing movement of the workpiece 10 in the X-Y plane can thus be provided. Depending on the work task, the workpiece 10 can be moveable by the feed device 22 both in the X direction and against the X direction. This movement of the workpiece 10 can be adapted to a movement of the upper tool 11 and lower tool 9 in and against the Y direction for the processing work task at hand.

The further workpiece rest 29 is provided on the machine frame 2 opposite the workpiece rest 28. This further workpiece rest can be associated, for example, with an unloading station. Alternatively, the loading of the unprocessed workpiece 10 and unloading of the processed workpiece 10 having workpieces 81 can also be associated with the same workpiece rest 28, 29.

The processing machine 1 can furthermore include a laser processing device 201, such as the laser cutting machine shown schematically in FIG. 5. This laser processing device 201 can be configured, for example, as a $CO_2$ laser cutting machine. The laser processing device 201 includes a laser source 202 that generates a laser beam 203 that is guided by a beam guide 204 (shown schematically) to a laser processing head, such as laser cutting head 206, and is focused therein. The laser beam 204 is then oriented perpendicularly to the surface of the workpiece 10 by a cutting nozzle to process the workpiece 10. The laser beam 203 acts on the workpiece 10 at the processing location, e.g., the cutting location, jointly with a process gas beam. The cutting point, at which the laser beam 203 impinges on the workpiece 10, is adjacent to the processing point of the upper tool 11 and lower tool 9.

The laser cutting head 206 is moveable by a linear drive 207 having a linear axis system at least in the Y direction, or in the Y and Z direction. This linear axis system, which receives the laser cutting head 206, can be associated with the machine frame 2, fixed thereto or integrated therein. A beam passage opening is provided in the workpiece rest 28, below a working space of the laser cutting head 206. A beam capture device for the laser beam 21 can be provided beneath the beam passage opening. The beam passage opening and as applicable the beam capture device can also be configured as one unit.

The laser processing device 201 can alternatively also include a solid-state laser as laser source 202, the radiation of which is guided to the laser cutting head 206 with the aid of a fiber-optic cable.

The workpiece rest 28, 29 can extend to the workpiece support 8, which at least partially surrounds the lower tool 9. Within a resultant free space created therebetween, the lower tool 9 is moveable along the lower positioning axis 25 in and against the Y direction.

Figure 6:
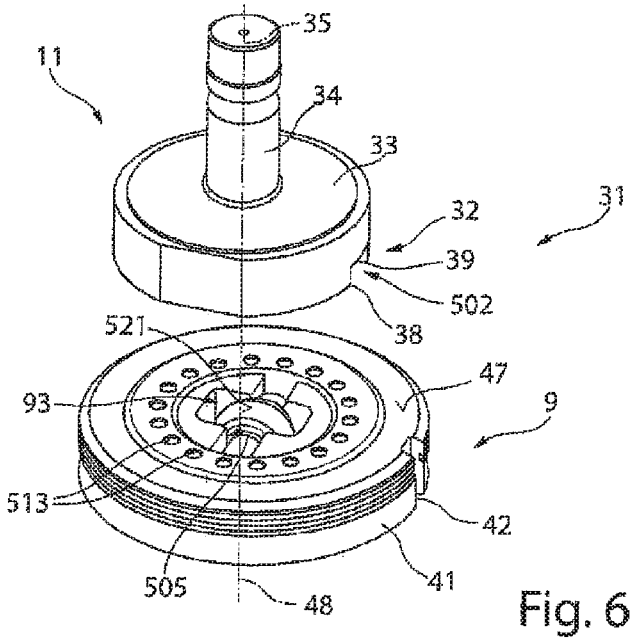
FIG. 6 shows a perspective view of a first embodiment of a tool.

For example, a processed workpiece 10 lies on the workpiece rest 28 and has a workpiece part 81 cut free by a cutting gap 83, for example by punching or by laser beam processing, apart from a remaining connection 82. The workpiece 81 is held in the workpiece 10 or the remaining sheet skeleton by this remaining connection. To separate the workpiece part 81 from the workpiece 10, the workpiece 10 is positioned by the feed device 22 relative to the upper and lower tool 11, 9 for a separation and discharge step. Here, the remaining connection 82 is separated by a punching stroke of the upper tool 11 relative to the lower tool 9. The workpiece part 81 can, for example, be discharged downwardly by partially lowering of the workpiece support 8. Alternatively, in the case of larger workpiece parts 81, the cut-free workpiece part 81 can be transferred back again to the workpiece rest 28 or onto the workpiece rest 29 to unload the workpiece part 81 and the sheet skeleton. Small workpiece parts 81 can also be discharged optionally through an opening in the lower tool 9. FIG. 6 shows a perspective view of a tool 31 that is intended for punching, cutting, embossing, and/or shaping or processing of the workpiece 10 with a pendulum stroke. Such a tool 31 is also known as a pendulum stroke tool. Reference is also made to the sectional illustration of the tool 31 in FIG. 7 in respect of the following description of this tool 31.

The upper tool 11 includes a main body 33 and a clamping shaft 34 arranged thereon. These have a common positioning axis 35. The main body 33 and the clamping shaft 34 can be formed as one part. The main body 33 can also be held clamped on the clamping shaft 34. An indexing wedge 36 is provided on the main body 33 and is used to orient the upper tool 11 in an upper tool receptacle of the processing machine 1. The main body 33 has a processing tool 37 opposite the clamping shaft 34 that is provided on the main body 33. In this embodiment of the upper tool 11 a holding-down surface 501 is provided on an underside of the main body 33. This holding-down surface 501 can be oriented at right angles to the positioning axis 35. A processing edge 38 of the processing tool 37 is provided adjacently to the holding-down surface 501. Two processing edges 38, 39 are arranged at a distance from each other. A processing surface 502 is provided in the main body 33 between the processing edges 38, 39 and is recessed relative to the processing edges 38, 39. An indentation 503 is thus provided in the main body 33, starting from the holding-down surface 501. The at least one processing edge 38, 39 extends advantageously perpendicularly to the positioning axis 35 and along the entire main body 33. An indentation that for example is groove-shaped thus extends along the entire holding-down surface 501.

The lower tool 9 includes a main body 41 that has an indexing element (not shown in greater detail) that is used to orient the lower tool 9 in a lower tool receptacle of the processing machine 1. The lower tool 9 includes a positioning axis 48. This positioning axis 48 can lie along the stroke axis 30, about which the lower tool 9 can be controlled rotatably.

A rest surface 47 is provided on the main body 41 of the lower tool 9 is oriented perpendicular to the positioning axis 48. The rest surface 47 can be oriented parallel to the holding-down surface 501. In the exemplary embodiment an opening 46 is provided in the rest surface 47, with a counter tool body 93 positioned in the opening. The counter tool body 93 can be positioned with respect to the rest surface 47 in such a way that the positioning axis 48 of the lower tool 9 crosses the counter tool body 93. The rest surface 47 can furthermore include sliding elements 513 that lie in the plane of the rest surface 47 and minimize friction between the workpieces 10 and the rest surface 47 of the lower tool 9 in the event of a relative movement.

The counter tool body 93 has a counter roller 505 that has at least one counter edge 506. Two counter edges 506 and 507 are arranged at a distance from each other. The distance between the processing edges 38, 39 advantageously corresponds to the distance between the counter edges 506, 507 and twice the material thickness of the workpiece 10 to be processed during a shaping operation. When separating the workpiece part 81 from the workpiece 10, the distance between the processing edges 38, 39 corresponds to the distance between the counter edges 506, 507 and the cutting play. A processing device 508 is adjacent to the at least one counter edge 506 or between the two counter edges 506 and 507 and is raised relative to the rest surface 47 and protrudes in the direction of the upper tool 11. The counter edges 506, 507 lie in the plane of the rest surface 47. Each counter edge 506, 507 is adjoined, opposite the processing device 508, by a support surface 509, 510 oriented parallel to the holding-down surface 501. The upper side or upper edge of the sliding elements 513 lie in the plane of the support surface 509, 510. The counter roller 505 is mounted in a rotary manner in the main body 41 of the lower tool 9 to rotate about a rotation axis 511. The rotation axis 511 is advantageously oriented perpendicular to the positioning axis 48 or parallel to the rest surface 47.

The processing device 508 has a counter surface 521 in the form of a circular segment as considered in cross-section. A bead 515 can be formed in the workpiece 10 by a processing device 508 of the aforementioned kind in cooperation with the processing tool 37 and has a course corresponding to the counter surface 521. Due to the design of the tool 31 with a counter roller 505, which is used to shape the workpiece 10, this tool 31 is also referred to as a roller tool, such as a roller bead tool or roller shaping tool.

Figure 8:
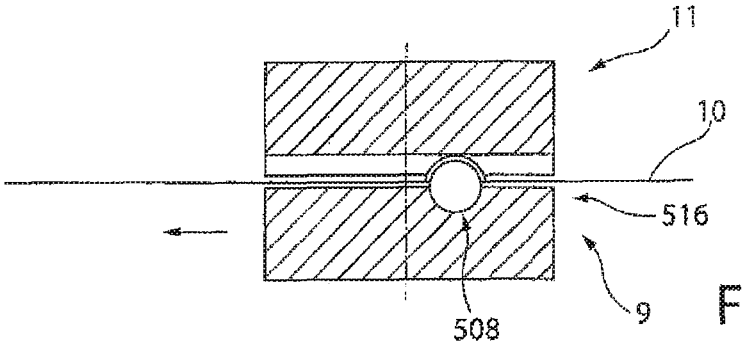
FIGS. 8 to 10 show schematic side views of the tool of FIG. 6 for successive process steps for processing the workpiece.
Figure 9:
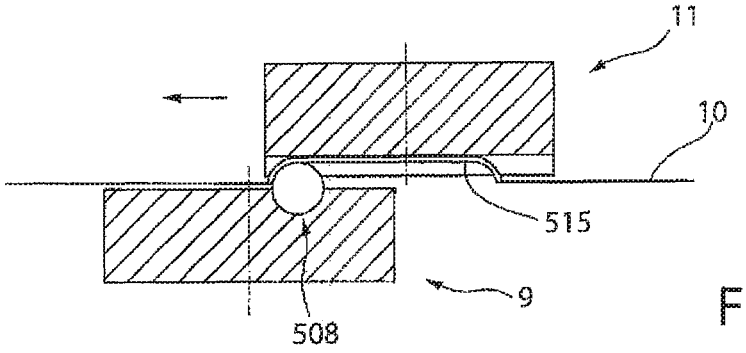
Figure 10:
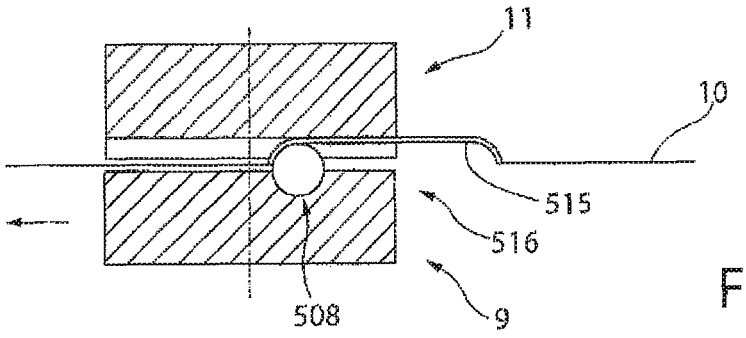

The production of a bead 515 in the workpiece 10 will be described in greater detail hereinafter with reference to FIGS. 8 to 10. In FIGS. 8 to 10 the main body 33 of the tool 31 with the processing tool 37 of the upper tool 11 and the main body 41 with the counter tool body 93 of the lower tool 9 are shown in a schematically simplified manner.

A planar workpiece 10 is positioned between the upper tool 11 and the lower tool 9. The upper tool and/or lower tool 11, 9 are/is then moved towards one another, e.g., along a stroke axis 14, 30, until they have transferred into a processing position 516 of FIG. 8. In this processing position 516 the workpiece 10 is clamped between the upper tool 11 and the lower tool 9. In this position the holding-down surface 501 bears against an upper side of the workpiece 10 and holds down the workpiece 10 towards the rest surface 47 on the lower tool 9. In this processing position 516 the counter surface 521 of the processing device 508 acts on the underside of the workpiece 10 and deforms it into the indentation 503 in the main body 33 of the upper tool 11. Here, the processing edges 38, 39 are opposite the counter edges 506, 507, at a distance equal to the thickness of the workpiece 10. Due to the raised embodiment of the processing device 508 and the mutually opposed positioning of the processing edge 38 relative to the counter edge 506 and of the processing edge 39 relative to the counter edge 507, the start of a bead 515 is formed.

The upper tool 11 and the workpiece 10 are then held stationary, and the lower tool 9 is controlled by a traversing movement along the lower positioning axis 25. This is shown in FIG. 9. By means of the traversing movement of the lower tool 9 relative to the stationary upper tool 11, the bead 515 is formed in the workpiece 10 that likewise is held still relative to the upper tool 11. By means of the counter roller 505 provided in the lower tool 9 with the support surfaces 509, 510 provided thereon and with the counter surface 521 of the processing device 508 and the sliding elements 513, a low coefficient of friction between the workpiece 10 and lower tool 9 is promoted. This first working stroke or pendulum stroke, during which the positioning axes 35 and 48 are offset parallel to one another, is ended before the counter roller 505 has reached the end of the processing edges 38, 39 of the processing tool 37.

In a subsequent working step shown in FIG. 10, the upper tool 11 is displaced along the upper positioning axis 16. The lower tool 9 and the workpiece 10 remain still during this traversing movement. The upper tool 11 can be raised slightly relative to the workpiece 10 during the traversing movement. The traversing movement of the upper tool 11 can be ended when the positioning axes 35, 38 are aligned again with one another. The traversing movement of the upper tool 11 is ended when a rear end portion of the processing edge 38, 39 still holds the workpiece 10 clamped against the processing device 508.

As the bead 515 is formed in the workpiece 10, the distance between the upper and lower tool 11, 9 in the region of the holding-down surface 501 relative to the rest surface 47 remains constant.

In accordance with an alternative embodiment (not shown in greater detail) of the tool 31, instead of the counter roller 505, the processing device 508 can be provided fixed to the main body 41 of the lower tool 9. The contour and form of the processing device 508 can correspond to that shown in FIGS. 6 and 7. A fixed processing device 508 can be provided if very thin workpieces or a very soft material are to be processed by a workpiece.

Figure 7:
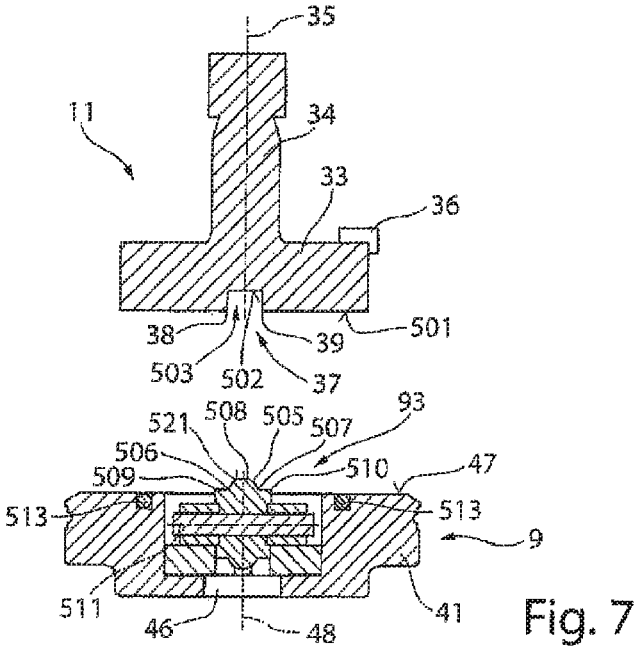
FIG. 7 shows a schematic sectional view of the tool of FIG. 6.
Figure 11:
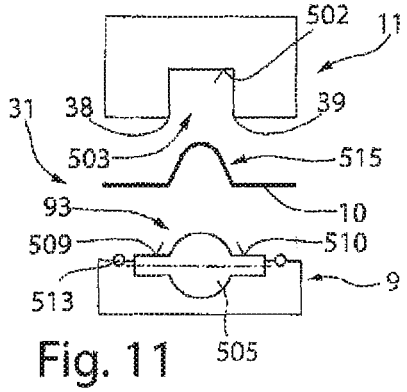
FIG. 11 shows a schematically simplified side view of the processed workpiece of FIGS. 8 to 10.

The embodiment of the tool 31 shown in FIGS. 6 and 7 is shown in schematically simplified form in a side view in FIG. 11, wherein the upper and lower tool 11, 9 are raised from one another. A sectional view of the processed workpiece 10 is shown therebetween. It is shown that the bead 515 is produced with the processing tool 37 on the upper tool 11 and a processing device 508 on the lower tool 9.

Figure 12:
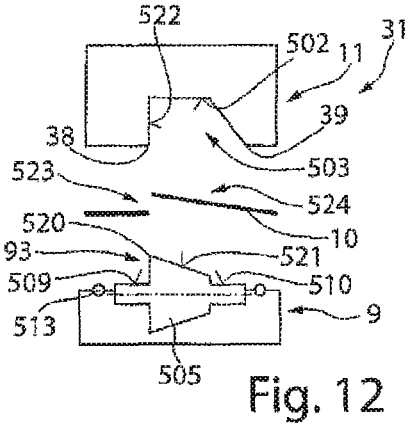
FIG. 12 shows a schematically simplified side view of an alternative embodiment compared to FIG. 11.

FIG. 12 shows a schematic side view of an alternative embodiment of the tool 31 as compared to FIG. 11. In this embodiment the counter roller 505 has a processing device 508 with a counter surface 521 that has a cutting edge 520 and a counter surface 521 adjoining the cutting edge and running therefrom at an incline. This counter surface 521 is formed as an inclined conical surface.

The upper tool 11 includes the processing edge 38 which is opposite the counter edge 506. In the processing position 516 of the upper tool 11 and lower tool 9, the cutting edge 520 can be guided along a cutting face 522 that adjoins the holding-down surface 501 at a right angle and protrudes into the indentation 503. A processing surface 502 and the indentation 503 for example are wider than the counter surface 521 of the processing device 508, such that a further processing edge 39 for example can come to rest on the rest surface 47. With a tool 31 of this kind, a cut 523 can be made in the workpiece 10, wherein at the same time a shaping or embossing is performed, for example so as to form a flange 524 on the workpiece 10.

Figure 13:
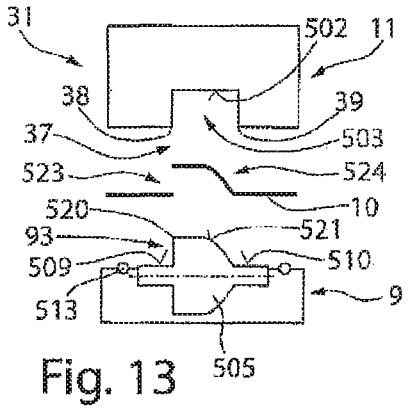
FIG. 13 shows a further schematically simplified side view of an alternative embodiment compared to FIG. 11.

FIG. 13 shows an alternative embodiment of the tool 31 as compared to FIG. 12. In this embodiment the processing device 508 likewise has a cutting edge 520, however this is adjoined by a bell-shaped counter surface 521. In addition, the processing edges 38, 39 of the processing tool 37 on the upper tool 11 are associated with the counter edges 506 and 507 on the counter roller 505 of the counter tool body 93 on the lower tool 9. In turn, a cut 523 and a curved flange 524 can thus be formed.

Figure 14:
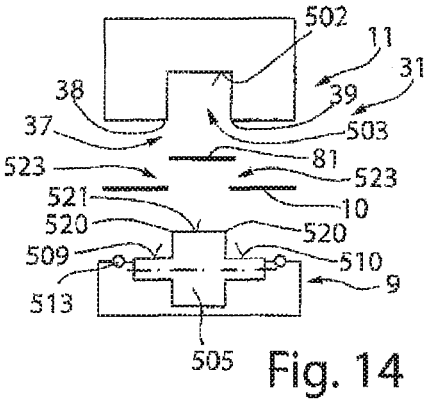
FIG. 14 shows a further schematically simplified side view of an alternative embodiment compared to FIG. 11.

FIG. 14 shows a further alternative embodiment of the tool 31 as compared to FIG. 11. In this embodiment, the upper tool 11 corresponds to the upper tool 11 of FIG. 11. The lower tool 9 receives a counter roller 505 with a processing device 508, in which two cutting edges 520 distanced from one another are provided. The counter surface 521 is formed therebetween. The processing device 508 is formed as a cylindrical roller, the extent of which is greater than that of the counter edges 506 and 507 or the support surfaces 509, 510 adjacent thereto. By transferring the upper tool 11 and lower tool 9 into the processing position 516, a cut 523 is made between the processing edge 38 and the counter edge 506 and between the processing edge 39 and the counter edge 507. In a cutting tool of this kind, a metal strip can be cut out from the workpiece 10.

Figure 15:
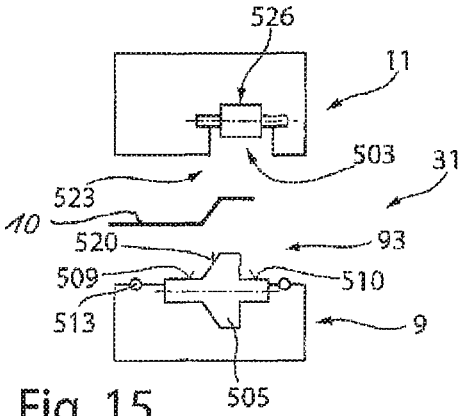
FIG. 15 shows a further schematically simplified side view of an alternative embodiment compared to FIG. 11.

FIG. 15 shows a further alternative embodiment of the tool 31. The upper tool 11 includes a support roller 526 as processing surface 502. A rotation axis of this support roller 526 can be oriented at a right angle to the positioning axis 35. It can also be oriented suitably relative to the positioning axis 35 depending on the contour to be formed in the workpiece 10.

A support roller 526 of this kind can also be used in the previously described embodiments.

The lower tool 9 has, as counter roller 505, a step-shaped or S-shaped counter surface 521. In this embodiment a free edge of the workpiece 10 is shaped, or includes an embossing. In this case the tool 31 can be referred to as a roller shaping tool or roller embossing tool.

Other Embodiments

A number of embodiments of the invention have been described. Nevertheless, it will be understood that various modifications may be made without departing from the spirit and scope of the invention. Accordingly, other embodiments are within the scope of the following claims.

What is claimed is:

1. A tool for processing a planar workpiece, comprising:

an upper tool having a clamping shaft and an upper main body that lie on a common, upper positioning axis;

a processing tool arranged on the upper main body opposite the clamping shaft, which comprises two fixed processing edges that are parallel to each other and delimit an indentation between them that extends along a holding-down surface of the entire upper main body, wherein the processing tool further comprises a processing surface within the indentation between the two fixed processing edges that extends along the entire upper main body;

a lower tool having a lower main body with a rest surface for the planar workpiece and a lower positioning axis oriented perpendicular to the rest surface;

a counter tool body on the lower main body, the counter tool body having a counter roller with at least one counter edge opposite the two fixed processing edges of the processing tool; and a processing device that is provided adjacent to the at least one counter edge, and that has at least one curved counter surface oriented aligned with the two processing edges of the processing tool, wherein the upper tool and lower tool are moveable towards one another in a stroke direction to process the planar workpiece arranged therebetween.

2. The tool of claim 1, wherein the two processing edges are oriented perpendicular to the common positioning axis.

3. The tool of claim 2, wherein the two processing edges cross the lower positioning axis.

4. The tool of claim 1, wherein the counter tool body is mounted in the lower main body rotatably about a rotation axis that is perpendicular to the lower positioning axis.

5. The tool of claim 4, wherein the at least one counter edge is located peripherally on the counter roller and is adjoined by a support surface that is oriented parallel to the holding-down surface of the upper main body.

6. The tool of claim 5, wherein the counter edge lies in a plane of the rest surface of the lower tool.

7. The tool of claim 5, wherein the at least one curved counter surface is opposite the support surface and adjacent to the at least one counter edge and engages at least partially in an indentation in a processing position of the upper tool relative to the lower tool.

8. The tool of claim 7, wherein the at least one curved counter surface is configured as a shaping surface with an adjacent cutting edge on one side, or a shaping surface with cutting edge delimiting the shaping surface on both sides.

9. The tool of claim 1, wherein the processing surface of the processing tool comprises a support roller arranged within the indentation in the upper main body between the two processing edges.

10. A machine for processing planar workpieces, comprising: a tool for processing a planar workpiece of claim 1, an upper stroke drive arranged to move the upper tool in a stroke direction along an upper stroke axis in a direction towards or away from the planar workpiece to be processed by the upper tool, wherein the upper tool is positionable along the upper positioning axis running perpendicular to the stroke axis;

an upper drive assembly arranged to move the upper tool along the upper positioning axis;

a lower stroke drive arranged to move the lower tool along a lower stroke axis in the direction of the upper tool, wherein the lower tool is positionable along a lower positioning axis oriented perpendicular to the stroke axis of the upper tool;

a lower drive assembly arranged to move the lower tool along the lower positioning axis; and a controller configured to control the upper stroke drive and the upper drive assembly to move the upper tool, and configured to control the lower stroke drive and the lower drive assembly to move the lower tool;

wherein a traversing movement of the upper tool along the upper positioning axis and a traversing movement of the lower tool along the lower positioning axis are controllable independently of each other.

* * * * *